US007235762B2

(12) United States Patent
Gagas et al.

(10) Patent No.: US 7,235,762 B2
(45) Date of Patent: Jun. 26, 2007

(54) FACTORY PRESET TEMPERATURE WARMING APPLIANCE

(75) Inventors: John M. Gagas, Milwaukee, WI (US); Scott A. Jonovic, Cottage Grove, WI (US); Daniel E. Stair, II, Cedarburg, WI (US)

(73) Assignee: Western Industries, Inc., Milwaukee, WI (US)

( * ) Notice: Subject to any disclaimer, the term of this patent is extended or adjusted under 35 U.S.C. 154(b) by 76 days.

(21) Appl. No.: 11/147,511

(22) Filed: Jun. 8, 2005

(65) Prior Publication Data

US 2005/0274712 A1 Dec. 15, 2005

Related U.S. Application Data

(60) Provisional application No. 60/579,469, filed on Jun. 14, 2004.

(51) Int. Cl.
*A21B 1/24* (2006.01)
*A21B 1/40* (2006.01)
*A21B 3/04* (2006.01)

(52) U.S. Cl. ..... 219/400; 219/385; 219/392; 219/401; 219/413; 219/494; 219/502

(58) Field of Classification Search ..... None
See application file for complete search history.

(56) References Cited

U.S. PATENT DOCUMENTS 3,978,238 A 8/1976 Frey et al.
4,039,776 A 8/1977 Roderick
4,309,584 A * 1/1982 Terakami ..... 219/720
4,345,143 A 8/1982 Craig et al.
4,439,459 A 3/1984 Swartley
4,444,175 A 4/1984 Reynolds
4,446,780 A * 5/1984 Puvogel et al. ..... 99/480
4,468,424 A 8/1984 Cartwright
4,503,760 A 3/1985 Pryputsch et al.
4,622,231 A 11/1986 Swartley
4,751,368 A 6/1988 Daifotes
4,751,911 A 6/1988 Betts et al.
4,980,539 A 12/1990 Walton (Continued)

OTHER PUBLICATIONS

Gagas et al., U.S. Appl. No. 11/216,314, titled "Non-Food Warmer Appliance", filed on Aug. 31, 2005 (Specification, Claims and Abstract 50 pgs., 11 pgs., of drawings, 61 total pgs.).

(Continued)

*Primary Examiner*—Joseph Pelham
(74) *Attorney, Agent, or Firm*—Boyle Fredrickson Newholm Stein & Gratz S.C.

(57) ABSTRACT

A warming appliance having factory preset temperature modes. The warming appliance comprises an enclosure having a wall. The enclosure defines an interior space having an opening. A drawer is configured to be reciprocally moved within the interior space. The drawer having a wall configured to close the opening. The heating apparatus is configured to change the temperature inside the drawer. The user interface is associated with the drawer and configured to control the heating apparatus. The temperature control apparatus is coupled to the heating apparatus and user interface. The temperature control apparatus is associated with the enclosure, wherein food stuff and objects contained in the drawer are maintained at a predetermined temperature.

56 Claims, 9 Drawing Sheets

U.S. PATENT DOCUMENTS 5,086,752 A 2/1992 Hait
5,233,969 A 8/1993 Koledin
5,360,965 A * 11/1994 Ishii et al. ..... 219/705
5,365,039 A 11/1994 Chaudoir
5,417,148 A 5/1995 Cavallo
5,466,058 A 11/1995 Chan
5,619,613 A 4/1997 Otaki
5,676,051 A * 10/1997 Sinemus ..... 99/476
5,712,464 A * 1/1998 Westerberg ..... 219/411
5,783,803 A 7/1998 Robards, Jr.
5,873,300 A 2/1999 Kuhlman
5,900,173 A 5/1999 Robards, Jr.
5,948,301 A 9/1999 Liebermann
6,041,773 A 3/2000 Rosenquist
6,108,486 A 8/2000 Sawabe et al.
6,111,224 A 8/2000 Witt
6,116,154 A 9/2000 Vaseloff
6,121,583 A 9/2000 Hansen
6,124,572 A 9/2000 Spilger et al.
6,166,353 A 12/2000 Senneville et al.
6,191,391 B1 2/2001 Deo et al.
6,259,067 B1 7/2001 Faries, Jr. et al.
6,265,695 B1 7/2001 Liebermann
6,376,805 B2 4/2002 Faries, Jr. et al.
6,384,380 B1 5/2002 Faries, Jr. et al.
6,414,283 B1 7/2002 McNamara
6,444,955 B1 * 9/2002 Loveless ..... 219/400
6,484,512 B1 * 11/2002 Anderson et al. ..... 62/3.2
6,523,458 B1 2/2003 Turner
6,612,116 B2 9/2003 Fu et al.
6,657,167 B2 * 12/2003 Loveless ..... 219/400
6,660,974 B2 12/2003 Faries, Jr. et al.
6,693,260 B1 * 2/2004 Rodrigues ..... 219/385
6,750,433 B2 * 6/2004 Guenther et al. ..... 219/506
6,832,732 B2 * 12/2004 Burkett et al. ..... 236/44 C
6,849,835 B2 * 2/2005 Bollmers et al. ..... 219/520
7,060,943 B2 * 6/2006 Hwang ..... 219/414
7,087,873 B2 * 8/2006 Hayakawa et al. ..... 219/682
2003/0024921 A1 * 2/2003 Reddy et al. ..... 219/400
2005/0087524 A1 * 4/2005 Zhang et al. ..... 219/400
2005/0211696 A1 * 9/2005 Adamski ..... 219/400

OTHER PUBLICATIONS

Gagas et al., U.S. Appl. No. 11/216,443, titled "Warming Apparatus", filed on Aug. 31, 2005 (Specification, Claims and Abstract 44 pgs., 16 pgs. of drawings, 60 total pgs.).
Wolf, "Warming Drawer Installation Instructions", bearing a date indication of Nov. 2004 (6 double-sided pgs.).
Wolf, "Warming Drawer Use & Care Information", bearing a date indication of Jan. 2004 (8 double-sided pgs.).

* cited by examiner

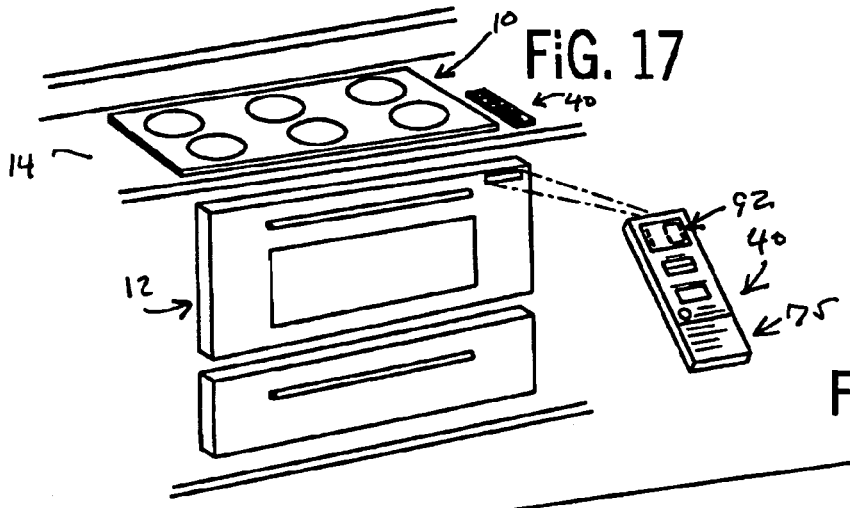
FiG. 17
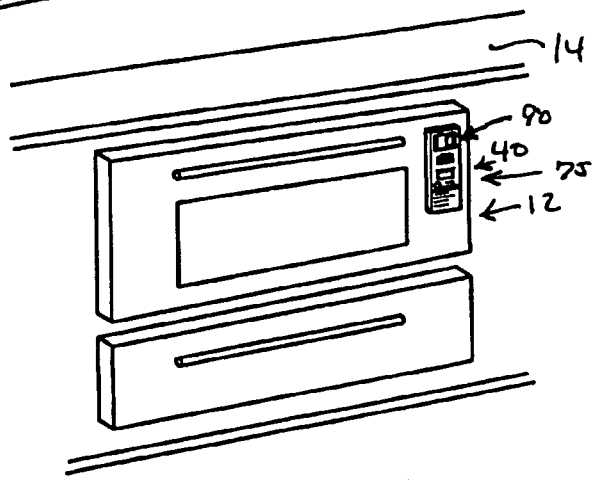
FiG. 18
FiG. 16
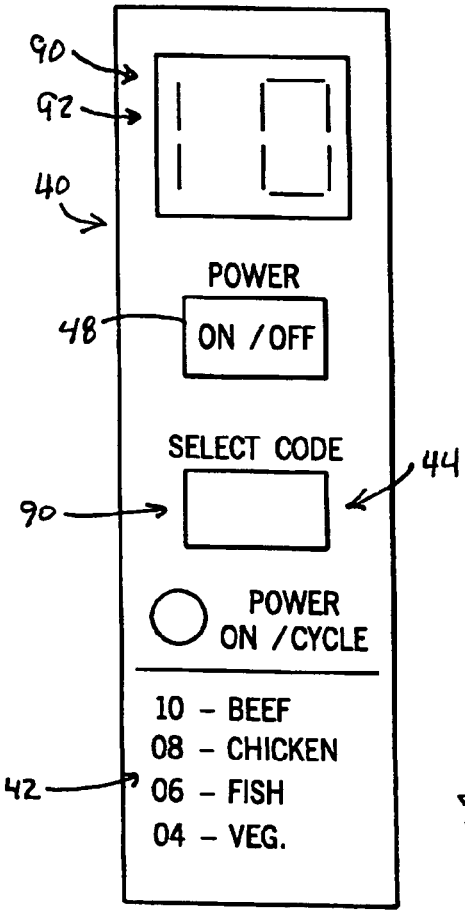
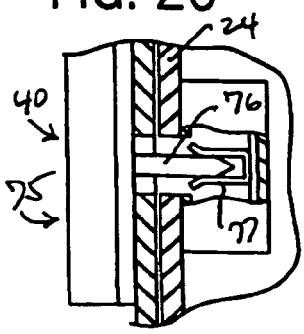
FiG. 20
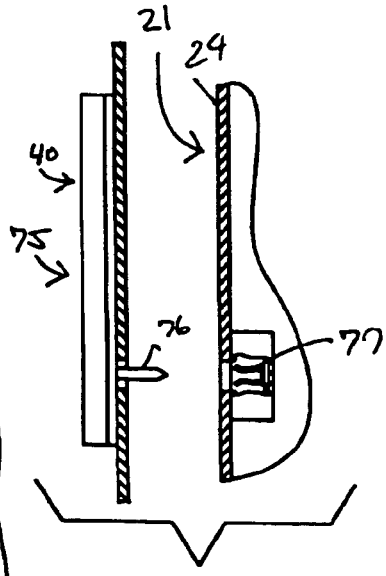
FiG. 19

FIG. 29
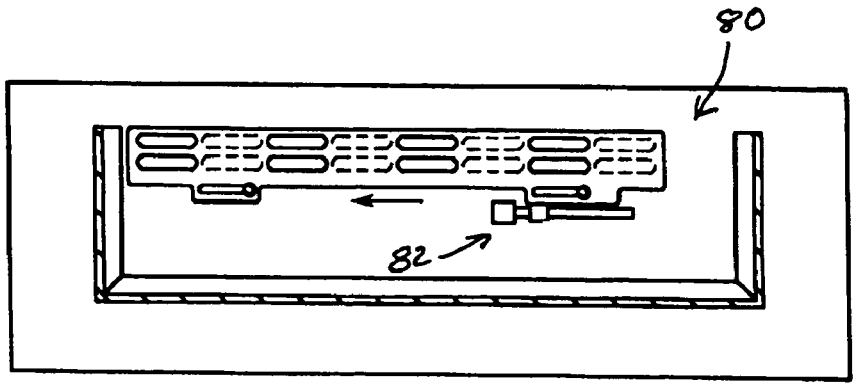
FIG. 30
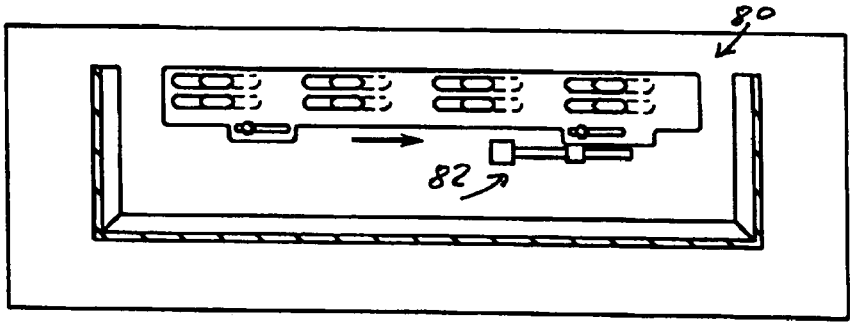
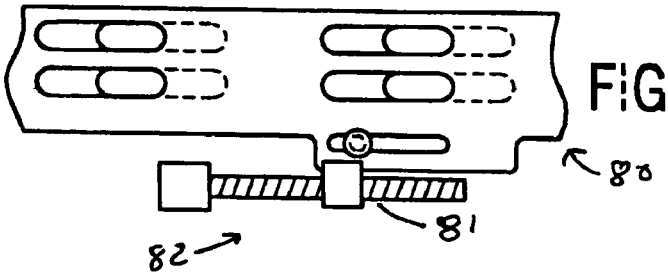
FIG. 31
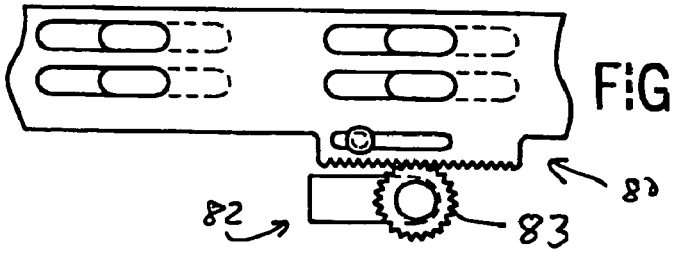
FIG. 32
FIG. 33
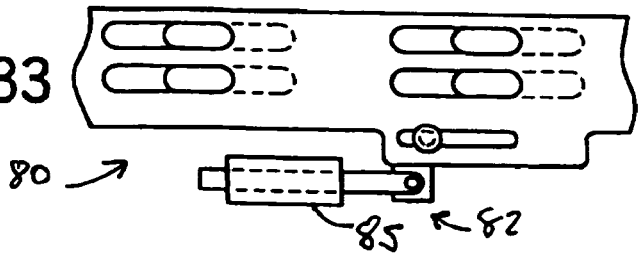

FACTORY PRESET TEMPERATURE WARMING APPLIANCE

CROSS-REFERENCE TO RELATED PATENT APPLICATIONS

This application is an application claiming the benefit under 35 USC 119(e) of U.S. Provisional Application 60/579,469, filed Jun. 14, 2004, incorporated herein by reference in its entirety.

FIELD

The present disclosure relates to a warming appliance, and more particularly a warming appliance having a factory preset temperature mode wherein an object contained in the appliance is maintained at a predetermined temperature.

BACKGROUND

Present warmer drawers use multiple/infinite function mechanical controls to control and maintain the food temperatures. These mechanical controls provide many options for setting temperatures for holding and warming food. Temperatures can range from ambient (temperature outside the appliance) to 230 degrees Fahrenheit (F.) and any temperature in between. These multiple/infinite function mechanical controls are inaccurate and have a tendency to dry food out, overheat, have large swings in temperature ranges from set point, which results in over and undershoots. This is partly due to the fact that users set the wrong temperature for holding or warming. These mechanical controls when placed in a warmer drawer do not show the precise temperature number or set point. The interface graphics merely show proof, low, medium or high. Other units may show a number at a location when in fact the user does not know what the inside temperature is without using some other means.

The sensors used to detect the present temperature in the chamber are mostly capillary tubes using expanding gases, liquids, and force transferring to a mechanical snap action switch, causing the switch to close or open. Thus supplying current to, or turning off, current to a heater, such as a cal rod. The response time for these types of controls is slow with the results of the heating of the chamber having overshoots and undershoots in temperature. With the user having the ability to set an infinite number of temperature set points, setting the right temperature can be a problem for the user. If the user sets the temperature too low for the food, the inside cavity chamber cools the food down. The user makes corrections to the temperature setting by increasing the setting to a new set point to which the resulting controller change results in a long lag for the cavity chamber to reach and become stable. This lag in time to reach temperature may result in the user setting to a higher set point. The user may continually change set points because of not being able to reach proper temperature. Such procedure can result in frustration and dislike for the warmer drawer as a result of dried out food, overheated or under heated food.

Present warmer drawers and the sensors used within the standard design of operation causes slow response for temperature corrections, thus causing temperatures to greatly overshoot and undershoot. The resulting temperature ranges and swings with multiple function controls, from the on to off cycling, have a greater tendency to drive moisture out of foods, hold more moisture in the chamber, and overcook food(s). Set points for proofing temperatures are typically provided but most users do not make bread in warmer drawers and do not use this feature. The ability of the user to go to lower temperature and higher temperature points and points in between is rarely used. For the most part user can benefit from a factory preset that is between 160 and 200 degrees F.

Present designs for the heating elements are located on the inside of the drawer enclosure. Located at the bottom of the chamber, with a cal rod used in varying patterns, the rod provides radiant heat. The heat produced rises slowly warming from the bottom to the top. Present designs provide varying temperature levels within the chamber. These differing temperatures cause problems for controlling and maintaining the food temperatures. Start up times to get warm temperatures in the cavity can be long due in part to the cal rod design. These long start(s) up times prevent a user from just turning on and placing food in. Present warmer drawers must have pre-heat up times in order to stabilize the temperature inside the cavity. Also as the temperature and heat are cycled you get large overshoots and undershoots of temperature causing food to dry out faster and with the loss of temperature control for longer periods, poor food holding capability results.

Present designs use mechanical switches for setting the desired temperature. These mechanical switches are inaccurate in their setting and repeatability. They have problems maintaining a set point showing swings in temperature partly due to the design of the warmer drawer and method of heating, but also due to the inaccuracy of the mechanical switches itself. Mechanical control switches have a known issue suffering from hysteresis, which contributes to their inaccuracies in the controllability to obtain and hold a set temperature point or repeat a function. This can be seen if you turn the control switch to the right and stop at a setpoint or turning the same mechanical switch going past the set point and then turning the control to the left stopping at the set point. The result will be a difference in temperature at the same set point. This issue results in a user not being able to obtain the same setpoint every time. If accurate, repeatable temperature(s) control is needed then the use of mechanical control does not deliver. The inaccuracy of the mechanical switch contributes to the large temperature swings inside the chamber of the warmer drawer. This inaccuracy contributes greatly to the radiant temperature problems found in most present warmer drawers with the chamber having overshoot and undershoot problems. Present design mechanical switches thus do not provide the user the ability to come back to present location or temperature(s) when setting up the operation for one operation to the next. The user cannot one day set the proper temperature and then the next day return to that same set point if the controls were moved. Temperature swings as much as 30 degrees or more have been seen.

Present designs are for built-in (used in a cabinet by itself) or built in a cabinet under or over a product such as a cook top, oven, or some other appliance. The warmer drawer can be used in a location all by itself, but in all cases are built into a cabinet or some structural frame, which is not moveable. This limits the warmer drawer from being placed in other areas. This also limits the warmer drawer(s) from being used as a freestanding unit, as in a mobile unit, used under a cabinet, or in areas that do not have a structural frame.

Therefore, there exists a need for a single preset temperature warmer drawer in which accurate heating control of food is accomplished. There exists the need for a fixed method of controlling the operation and setting of temperature in a warmer drawer. There is a further need to accurately apply and control heat to the warmer drawer. There also is a need for a factory preset temperature warning appliance that is portable and can be used outdoors.

SUMMARY OF THE INVENTION

There is provided a warming appliance having preset temperature modes. The warming appliance comprises an enclosure having a wall. The enclosure defines an interior space having an opening. A drawer is configured to be reciprocally moved within the interior space. The drawer having a member (wall) configured to close the opening. The heating apparatus is configured to change the temperature inside the drawer. The user interface is associated with the drawer and configured to control the heating apparatus. The temperature control apparatus is coupled to the heating apparatus and user interface. The temperature control apparatus is associated with the enclosure, wherein food stuff and objects contained in the drawer are maintained at a predetermined temperature. Another embodiment of the warming appliance provides the temperature control apparatus including a detector configured to sense the temperature in the drawer. A power circuit electrically connected to the detector, heating element, user interface and energy source. An electronic control device is coupled to the detector and power circuit to control the temperature in the drawer within a predetermined range. The heating apparatus can be mounted in the interior space proximate the drawer or the heating apparatus can be mounted external to the drawer and be in communication with the interior space.

There is also provided a warming drawer associated with a cooking appliance. The cooking appliance is one of a freestanding unit and a built in unit. The warming drawer comprises an enclosure having a wall. The enclosure defines an interior space and having an opening. A drawer is configured to be reciprocally moved within the interior space. The drawer has a member (wall) configured to close the opening. The heating apparatus is configured to change the temperature inside the drawer. The user interface associated with the drawer and configured to control the heating apparatus is provided. A temperature control apparatus is coupled to the heating element and user interface and associated with the enclosure, wherein food stuff and objects contained in the drawer are maintained at a predetermined temperature. Another embodiment provides a temperature control apparatus including a detector configured to sense the temperature in the drawer. A power circuit electrically connected to the detector, heating element, user interface and an energy source. An electronic control device coupled to the detector and power circuit to control the temperature in the drawer within a predetermined range.

BRIEF DESCRIPTION OF THE DRAWINGS

FIG. 16 is an illustration of exemplary embodiment of a user interface for a warming appliance, with the user interface having a plurality of food type designators, with each designator assigned a predetermined temperature stored in a microprocessor as a component of an electronic PC board coupled to the warming appliance.

FIG. 17 is a perspective view of an exemplary embodiment of a multi-use warming appliance associated with another appliance and controllable remotely with a remote control unit.

FIG. 18 is a perspective view of an exemplary embodiment of a multi-use warming appliance having a removable remote control unit coupled to the face plate of the appliance.

FIGS. 19 and 20 are detailed views of an exemplary embodiment of a coupling method of the user interface of the warming appliance illustrated in FIG. 18.

FIG. 29 is a plan view of an exemplary embodiment of a venting apparatus powered with a venting actuator.

FIG. 30 is a plan view of the venting apparatus illustrated in FIG. 29 illustrating a position different from that illustrated in FIG. 29.

FIG. 31 is a plan view of an exemplary embodiment of a venting actuator of a screw drive type.

FIG. 32 is a plan view of an exemplary embodiment of a venting actuator of a gear device.

FIG. 33 is a plan view of an exemplary embodiment of a venting actuator of a solenoid drive.

DETAILED DESCRIPTION OF THE EXEMPLARY EMBODIMENTS

Figure 2:
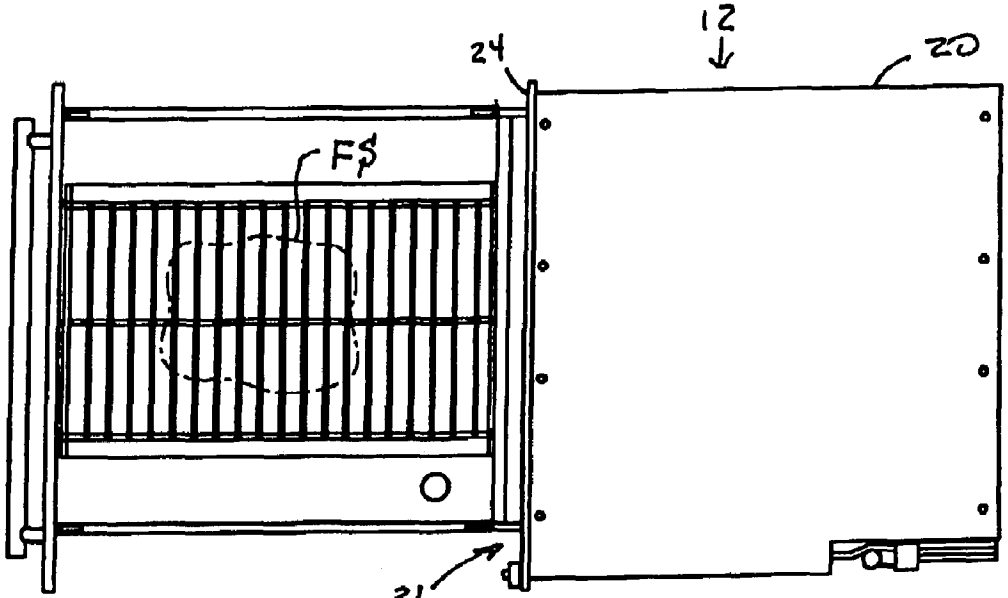
FIG. 2 is a top plan view of the warming appliance illustrated in FIG. 1.
Figure 1:
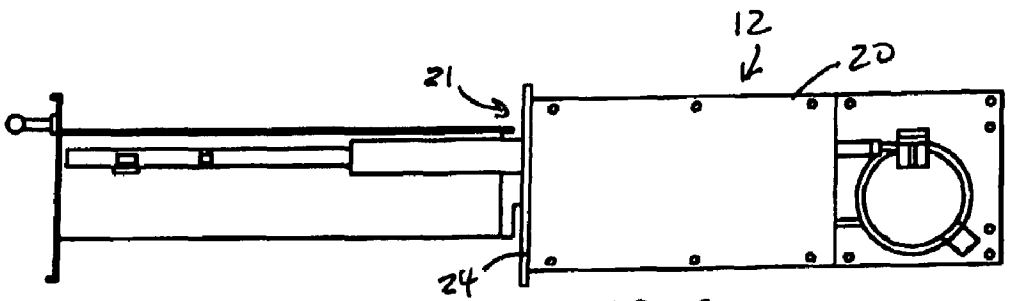
FIG. 1 is a side plan view of an exemplary embodiment of a warming appliance including a factory preset temperature mode, with a drawer extended from an enclosure.
Figure 3:
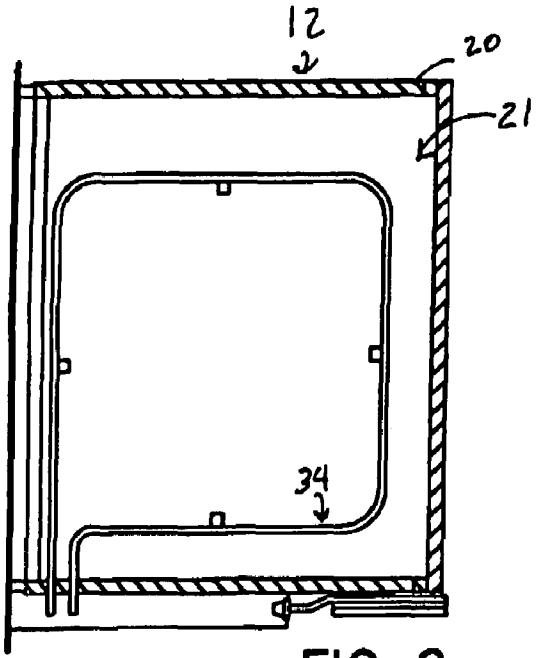
FIG. 3 is an illustration of an exemplary embodiment of a heating apparatus in a warming appliance.
Figure 4:
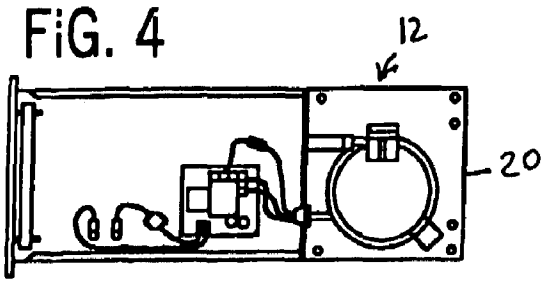
FIG. 4 is a side plan view of a warming appliance with a drawer in a closed position and illustrating an exemplary embodiment of a user interface, power circuit and an electronic control device.
Figure 5:
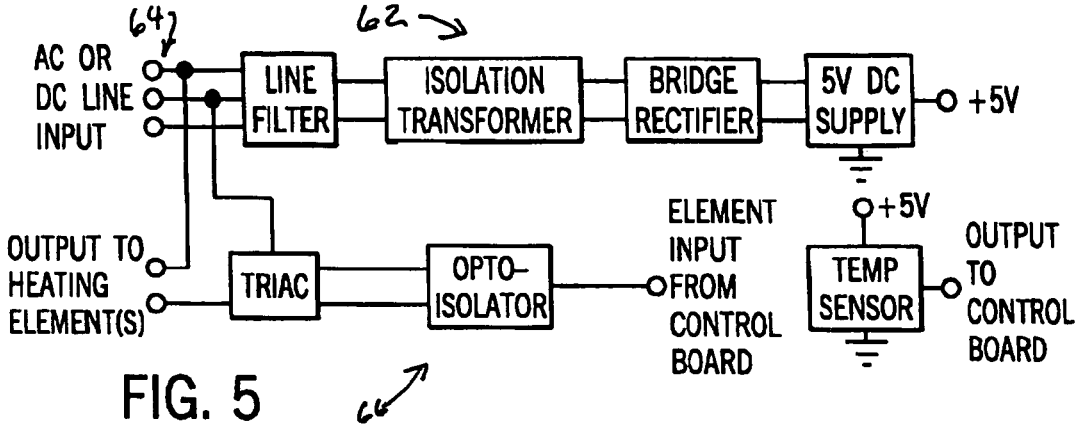
FIG. 5 is a block diagram of an exemplary embodiment of a power circuit for a warming appliance having a factory preset temperature mode.
Figure 6:
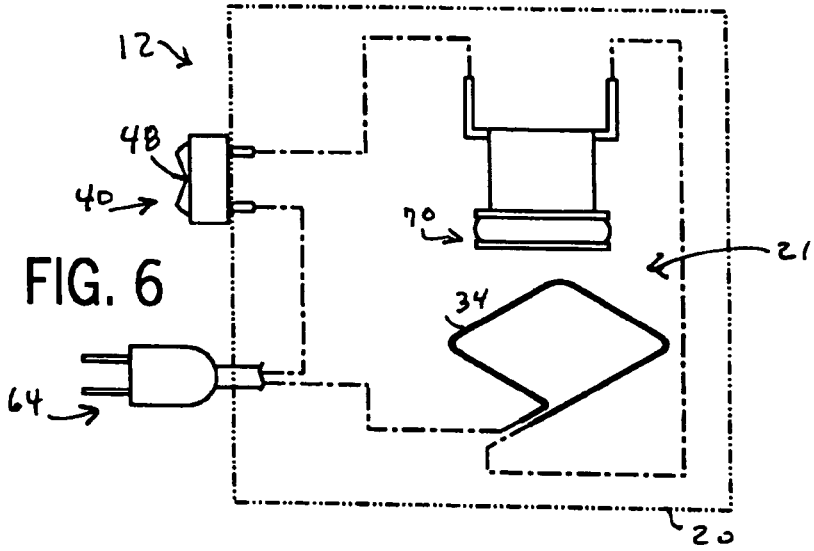
FIG. 6 is an illustration of an exemplary embodiment of a warming appliance having an on/off user interface and a disk thermostat type temperature control apparatus.
Figure 7:
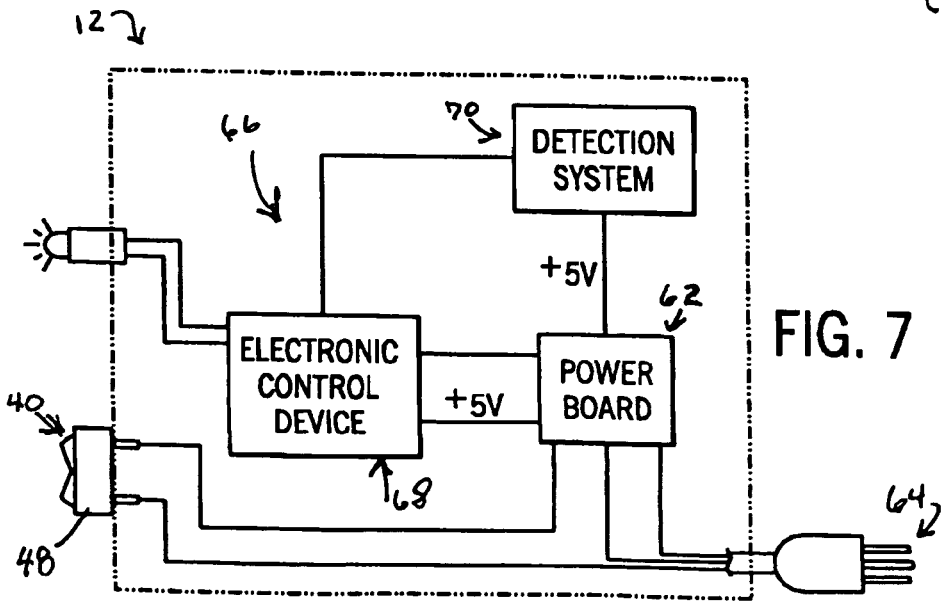
FIG. 7 is an illustration of an exemplary embodiment of a warming appliance having a user interface, power circuit, detector, and an electronic control device.
Figure 8:
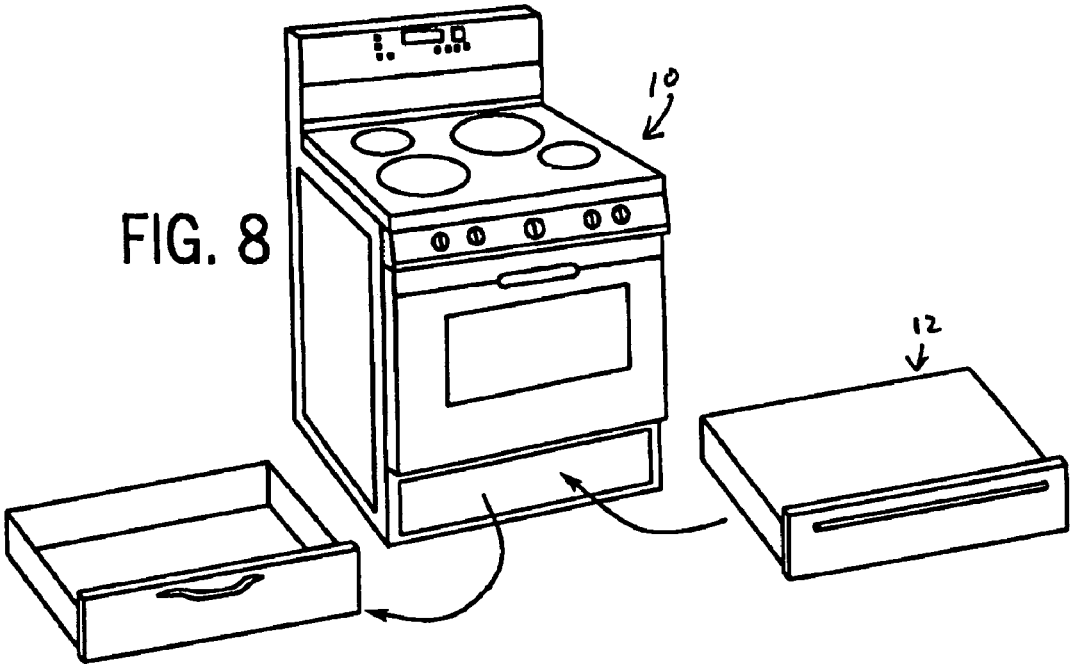
FIG. 8 is a perspective illustration of an appliance configured to exchange a storage drawer (left device) for an exemplary embodiment of a warming appliance (right device).
Figure 9:
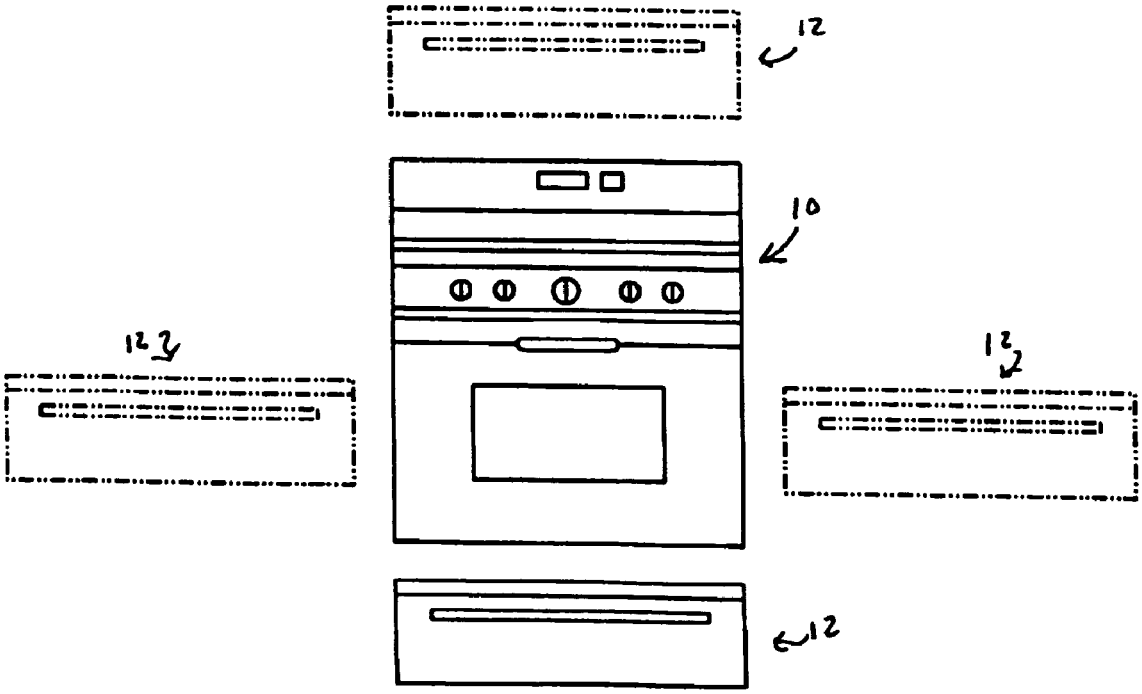
FIG. 9 is an illustration of possible locations of a warming appliance in relation to another appliance (a stove is illustrated).
Figure 10:
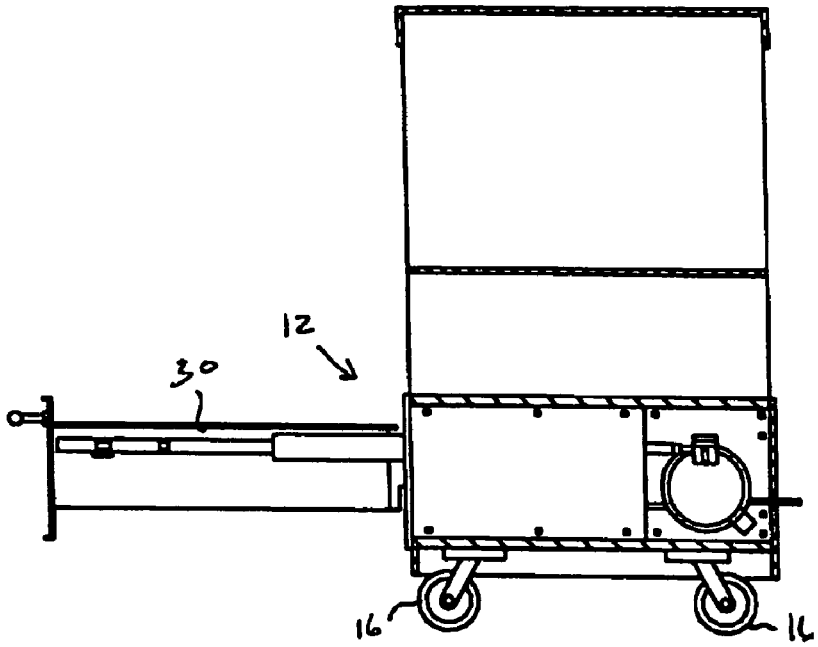
FIG. 10 is a side sectional view of an exemplary embodiment of a free standing warming appliance mounted on wheels.
Figure 11:
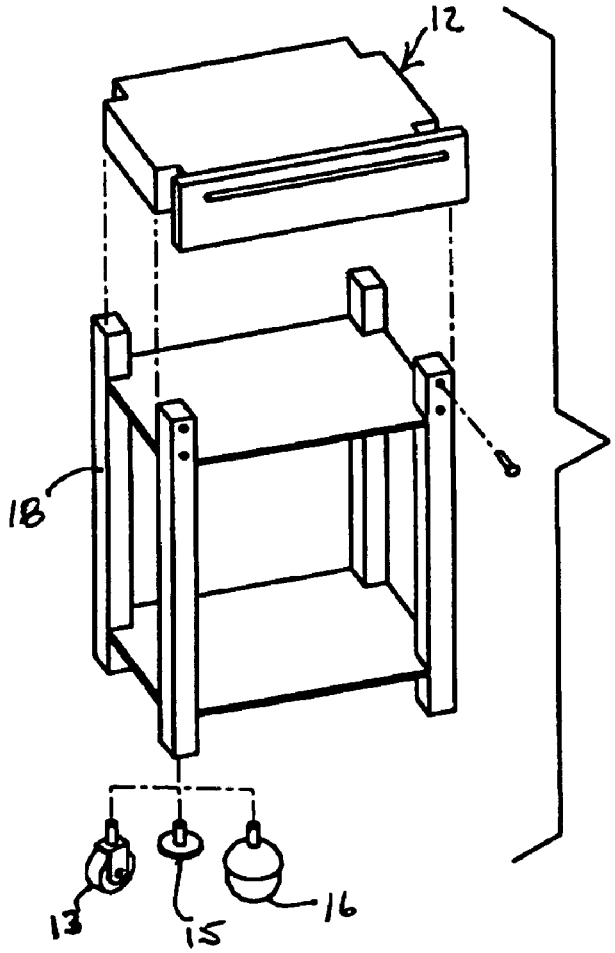
FIG. 11 is a perspective view of an exemplary multi-use warming appliance configured to couple to a stand structure which can be movable, as facilitated by several alternative devices.
Figure 12:
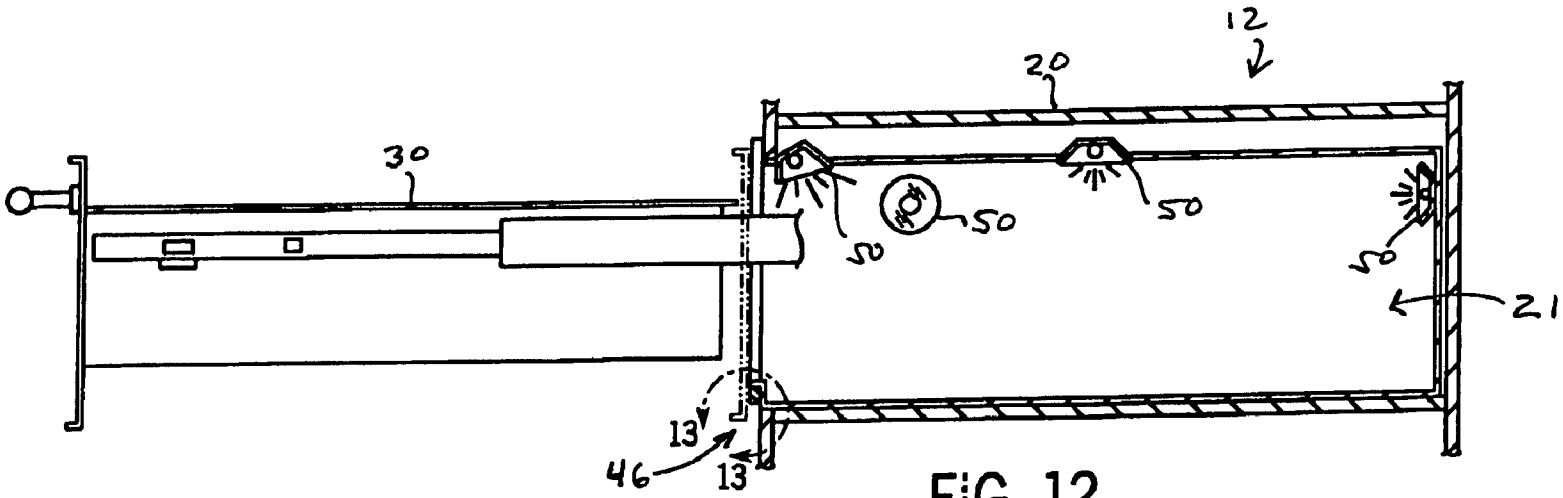
FIG. 12 is a sectional view of an exemplary embodiment of a warming appliance illustrating several locations of light fixtures mounted in the enclosure.
Figure 15:
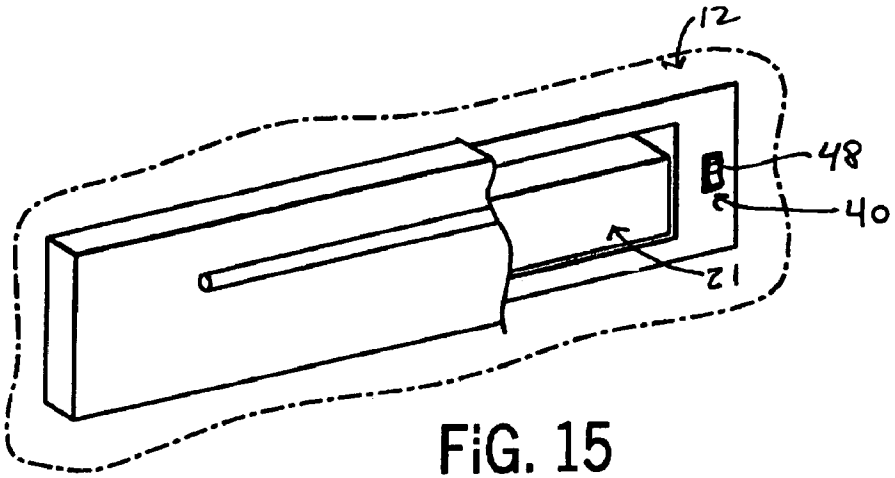
FIG. 15 is a partial perspective view of an exemplary embodiment of a face plate of a warming appliance including an on/off type user interface.
Figure 13:
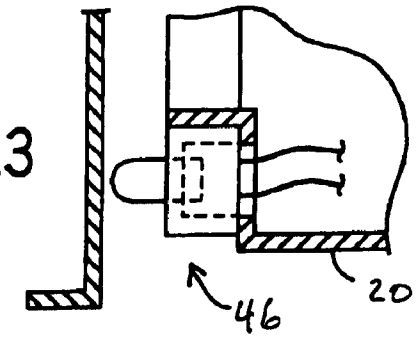
FIG. 13 is a detailed view of a mechanical door switch for operating the light fixtures of the warming appliance illustrated in FIG. 12.
Figure 14:
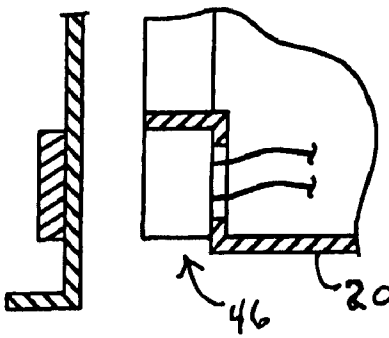
FIG. 14 is a detailed view of an electronic door switch activated with a magnet for operating the light fixtures of the warming appliance illustrated in FIG. 12.
Figures 21, 22, 23, 24:
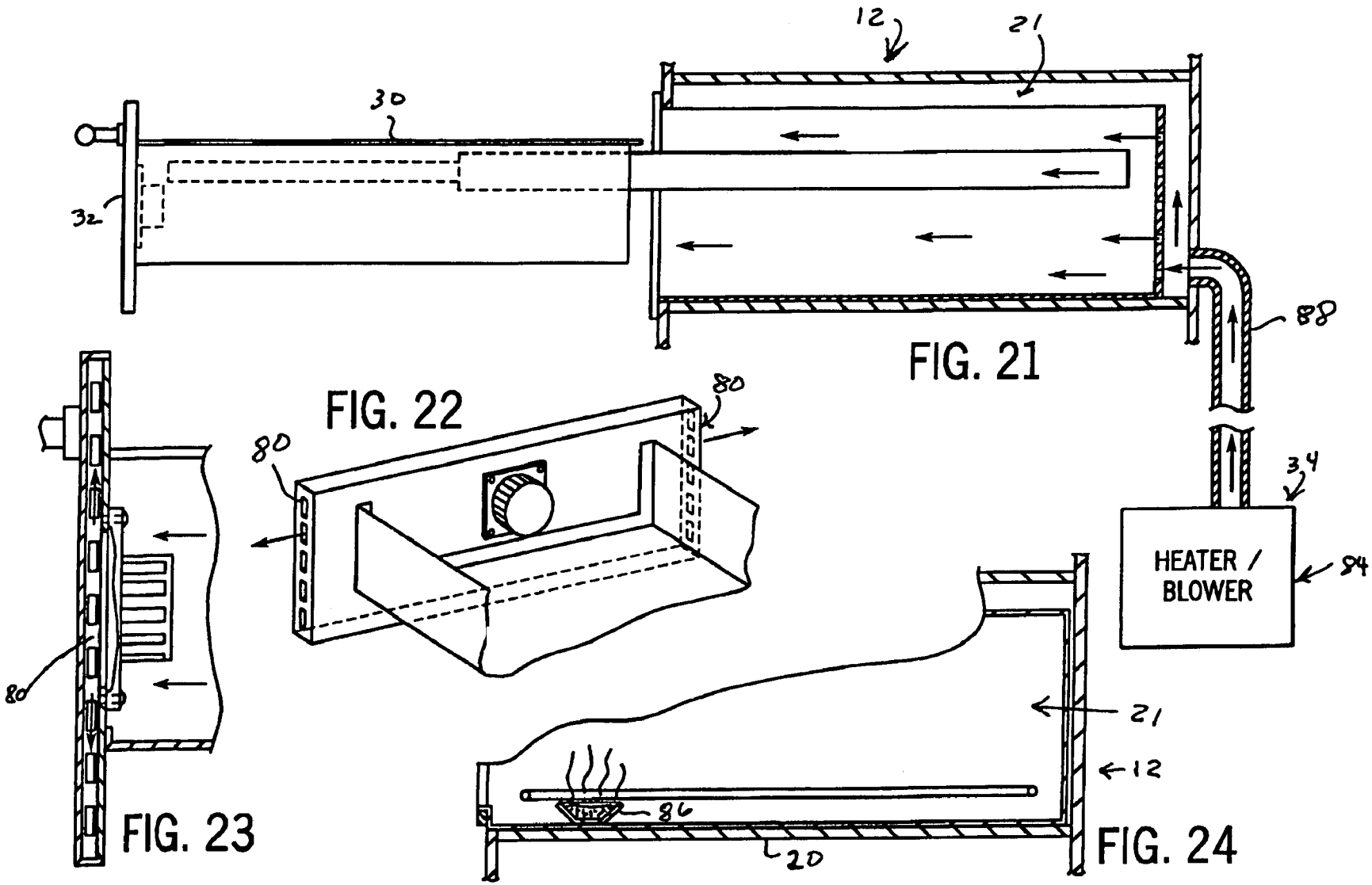
FIG. 21 is a sectional side view of an exemplary embodiment of a warming appliance coupled to a heater/blower.
FIG. 22 is a partial perspective view of an exemplary embodiment of a warming appliance illustrating alternative venting from the cavity (arrows depict air flow).
FIG. 23 is a side view of the venting illustrated in FIG. 22.
FIG. 24 is a partial side sectional view of an exemplary embodiment of a warming appliance including a depository for a fragrant substance in gaseous communication with the drawer of the appliance.
Figure 25:
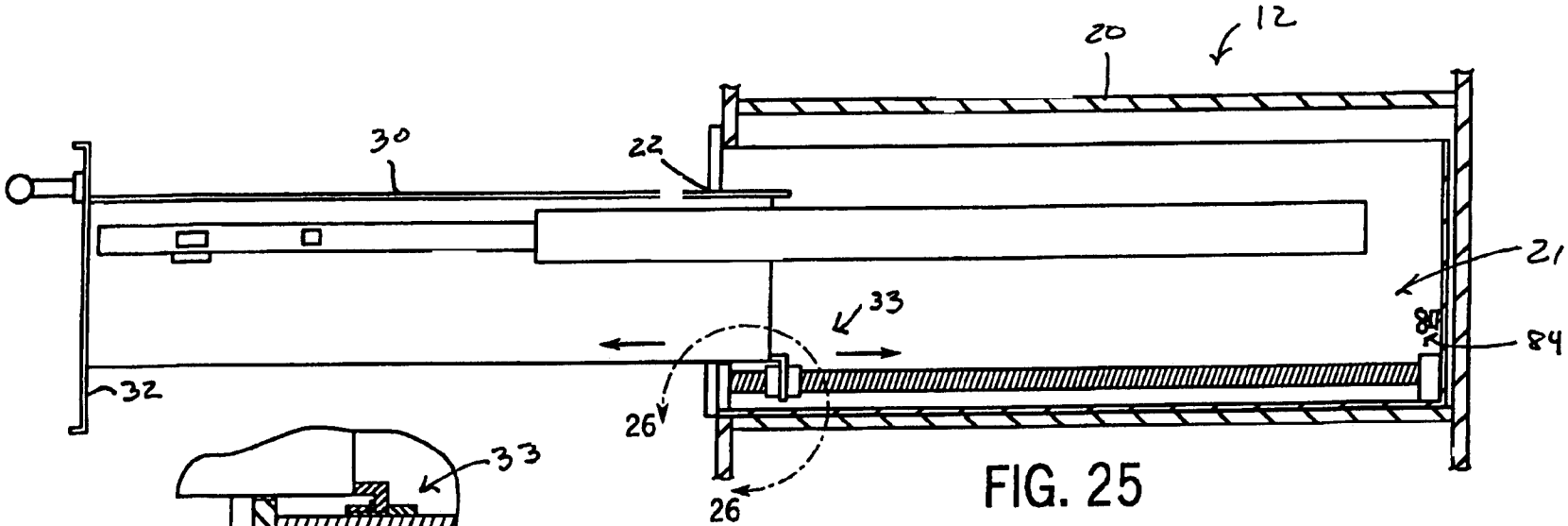
FIG. 25 is a side sectional view of an exemplary embodiment of a multi-use warming appliance, including a powered drawer.
Figure 26:
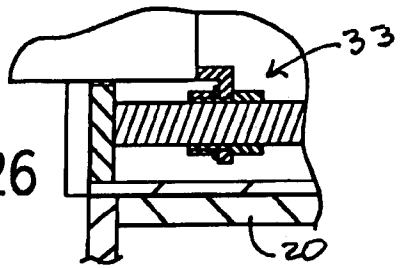
FIG. 26 is a detailed view of an exemplary embodiment of the powered drawer illustrated in FIG. 25.
Figure 28:
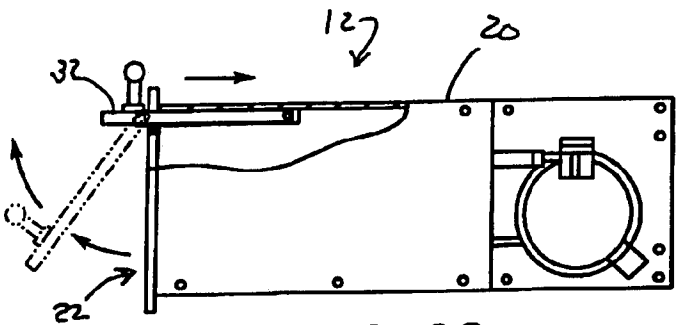
FIGS. 27 and 28 are alternative embodiments of a warming appliance illustrating coupling and motion of the door for the appliance.
Figure 27:
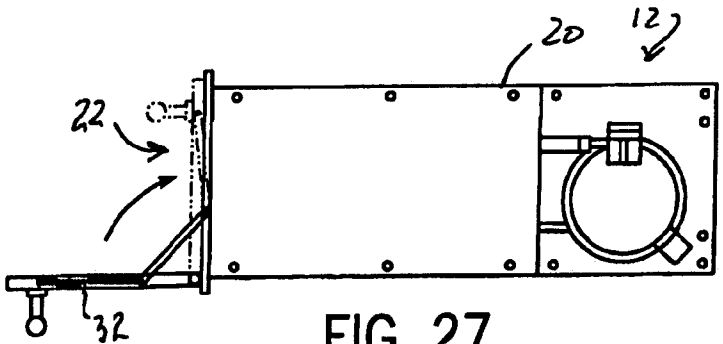

Referring to the FIGS. 1–33, there is provided exemplary embodiments of a warmer appliance 12, such as a warming drawer 12. The warmer drawer 12 typically includes an enclosure 20 including top, bottom, and side walls forming an outer wrap. These three items provided the outer cabinet. The use of only an inner cavity is acceptable as long as the surrounding surfaces can take the heat loss, for example in kitchen cabinetry 14. The interior space or cavity 21 is composed of a cavity bottom and sides, cavity top and back make up the full inner cavity, and bottom typically provides the heat protection. A faceplate 24 provides the connection for the inner cavity 21 to the front of the warmer drawer 12. Note here that there are many ways to construct a warmer drawer enclosure. This describes one way to construct a warmer drawer 12.

A warmer drawer 12 includes a heating apparatus 34, for example a heating element. A cal rod typically is used presently in all warmer drawers. There are alternative heating apparatus 34 or elements that can replace or be added to the standard, single cal rod style. Heating elements 34 for replacement or addition are: cross flow blower with an integrated heating element; convection heater(s); axial fan heaters (having a heating element and a fan); wire heating element(s) may be sheathed; heat plate(s); thermal ceramic heater(s); flexible heater(s) which are also called thin film heating elements. Flexible heaters can be configured into any desired shape. Other types of heating elements 34 are: light(s); inductive heater; heat pump type which can provide heating and cooling; microwave, infrared heaters (IR); electromagnetic; radio frequency; warming liquids; sonic; heat exchanger, gas, and solid fuel products. These heating elements can be placed not only on the bottom of the cavity but also on the walls, on the top, at the front, and in the back of a warmer drawer. The heating element 34 can also be mounted remote from the warming appliance 12 but in communication, for example, a duct 88, with the warming appliance 12. (See FIG. 21) Using these types of heating elements 34 alone or in combination will increase in the heat control and accuracy of the inside temperature of the cavity 21, thereby achieving even temperatures throughout the inside cavity 21. Multiple heating elements 34 can be used to improve on the temperature(s) in a cavity 21 and start heat up times. The use of electronic(s) and different heating elements 34 can greatly improve on the start up times reaching set temperatures faster. Pre-heat up times, in order to stabilize the temperature inside the cavity, are reduced with the use of heater elements 34 listed above instead of the conventional cal-rod type heater. Greater temperature control means less over and undershoots of temperature resulting in better food temperature holding capability. Greater versatility can be had with the use of electronics 66 and the different types of heating elements 34.

The ability to regulate the electric current to the heating elements 34 such that the power output can be increased or reduced, increasing or decreasing the heat output to the cavity 21 chamber is an advantage. Conventional warming appliance heaters are cycled on and off with the resulting supplied current also being cycled on and off to the heating element with the element delivering full heat when powered on and complete heat off. With the improved method described herein one can determine the needed heat load for the cavity 21 chamber and only supply a given amount of heat. This also can prevent temperature overshoots by quick warm-ups and when almost reaching the fixed set point limiting the amount of energy heat (current) when reaching the fixed set point. This can be done with electronics 66, for example an electronic printed circuit (PC) control board equipped with micro/electronic/electric technology (for example a microprocessor) and in communication with a positive temperature coefficient of resistance (PTC) current/voltage controller. PTC Thermistors (thermally sensitive resistors) are solid state, electronic devices, which detect thermal environmental changes for use in temperature measurement, control and compensation circuitry. Positive Temperature Coefficient (PTC) thermistors exhibit an increase in electrical resistance when subjected to an increase in body temperature. PTC devices remain in their low resistance state at all temperatures below the switch temperature. When the switch temperature is reached or exceeded, PTC's increase in resistance rapidly thereby limiting current to the heating element circuitry eliminating the overshoot. Once the temperature decreases to a normal operating level, the device resets to its low resistance state providing full load current to the heating element. The dramatic rise in resistance of a PTC Thermistor at the transition temperature makes it an ideal candidate for current limiting applications. For currents below the limiting current, the power being generated in the unit is not sufficient to heat the PTC to its transition temperatures. However, when abnormally high fault currents flow, the resistance of the PTC increases at such a rapid rate that any increase in power dissipation results in a reduction in current. These devices have a resistance temperature characteristic that exhibits a very small negative temperature coefficient until the device reaches a critical temperature for the upper limit or set point of the warmer drawer, which is referred to as the "curie," switch, or transition temperature. As this critical temperature is approached, the PTC device begins to exhibit a rising positive temperature coefficient of resistance as well as a large increase in resistance. This resistance change can be as much as several orders of magnitude within a temperature span of a few degrees. Thus as the cavity chamber temperature increases from an ambient temperature, the PTC electronic device increases in surface temperature reducing the ability to dissipate heat which results in an increase in resistance resulting in reducing the current to the heating element. This increase in resistance and reducing current also slows down the heat up when coming to the set point. These devices also do not completely stop the flow of current to the heating element, but limit the current. Thus providing and maintaining a steady temperature eliminating on/off swings that other styles provide. This design also provides users with cost savings. You do not have the on/off cycling as present designs, with the overshoots and undershoots, and the full current draw of the heating element, but with this design you only are providing the required current for heating and maintaining.

Such embodiment as described above is an improvement over prior art cycling power on and off in an attempt to control the heat. With the improved method one can determine the needed heat load for the cavity 21 chamber and only supply that amount of power/heat. This also can prevent temperature over shoots by quick warm ups and when almost reaching the fixed set point, limit the amount of energy heat (current) when reaching the fixed set point. The ability to better regulate the electrical current to the heating elements 34 such that the power output can be regulated will improve accuracy, and similarly increase or decrease the heat output to the cavity 21 chamber with greater accuracy. This innovation reduces the user's cost to operate this product. The electronics 66 and sensors 70 can determine the needed heat load for the cavity 21 chamber and only supply that amount of heat to the chamber 20.

The interfacing of the operations and controls with the user is limited to an on/off switch 48. The ability to not display to the user the operations, functions, temperatures and times using electronics and/or mechanical control simplifies the user involvement with the appliance. The factory preset temperature configuration provides accurate control for these operations without excessive user action thereby advancing the ability to cook and hold food.

The user interface 40 can be, for example, membrane switches, piezo electric, padless touch soft switch technology, padless touch digital encoder, infrared frequency dependent, magnetic switches, field effect, charge transfer, hall effect transistor, micro encoder, capacitance, resistance devices any of which can be fitted with decorative overlays, labels, trim as the interface with the user, for providing the on/off function. Such switch or switches can be installed on the warmer drawer 12 flush, recessed or raised and coupled to the electronics 66. The switch 48 can be installed in any plane with the use of electronics controls 66, electromechanical, or mechanical device(s). Electronic controls 66 or mechanical device(s) can be placed on any surface. This can be done to accommodate any design for matching other products. On/off device(s) can be placed on the front of a drawer door providing the user with the fixed operations and functions without having to open up the drawer. The device (s) can be rotated for viewing, fixed in place, or covered to protect the device, but can be viewed without being part of the drawer front or having to open the drawer for viewing. The use of electronics/micro-technology 68 for example a micro-controller, microprocessor, integrated circuits and drivers, PC Board(s), processor, and power circuits, and other electronics can be used in the control of functions, operations, and temperature(s), but are factory preset, having the user limited to just turning the unit on and off, or inputting a set code.

The warming appliance 12 can be provided with an information output device 90. The information output device 90 can be associated with the user interface 40, for example a visual and audio signal or otherwise coupled to the warming appliance 12 to provide user feedback concerning conditions related to the appliance 12 and items inside the cavity 21. The information output device 90 may include a digital display 92 of text, symbols, numbers or the like and may further include an electronic control panel having at least one of: membrane switch, piezo electric, padless touch soft technology, padless touch digital encoder, infrared frequency dependent, magnetic switch, field effect, charge transfer, hall effect transistor, micro encoder, capacitance, resistance devices which can be fitted with decorative overlay, label, or trim as the interface with the user. The information out put device 90 can also be configured with an output display, a rotating display, an LED display, an LCD display, a sliding panel, a retractable display, a removable display, a fixed display, an illuminated display that can be adjusted in color and intensity, a plasma display, a dot matrix display, a vacuum fluorescent display, and a pop up display.

Any size from a small to a large warmer drawer/multi-use drawer 12 can be fitted for use with a fixed operation and an on/off device 48. The overall size, design, look, and feel of a warmer drawer/multi-use drawer 12 can be matched to the size, design, look and feel of any appliance(s) 10 associated with the warmer drawer.

The user interface 40 for on/off 48 can be remotely controlled having the device(s) located not on the product, but in a different location. Remote control can be by wire or by wireless, for example infrared signal, sound and radio frequency controlling the function(s)/operation(s) of a warmer drawer. The use of electronic(s) 66 provides for better control and offers more operations than can be had in a mechanical control but the user only has to turn the appliance on and off. With the flexibility of the electronics, the user can receive better control but the warmer drawer 12 is factory preset and cannot be modified for the function(s)/operation(s) and temperature(s) of the warmer drawer 12.

A warmer drawer 12 configured with factory preset operations, functions, and temperatures, using a blower or fan 84, with or without a heating element attached to the fan 84, secured to the inside of the cavity 21 or remotely but in fluid communication with the appliance 12, to circulate heated air will provide better heat control and response time. With circulating air, hot spots within the cavity 21 are eliminated. Slow moving heated air will not degrade the food hold quality, but will improve on it because you will eliminate the over and undershoots of the temperatures. Improvements on the cavity temperature eliminate the temperature swing differences inside the cavity chamber thus providing better control and not requiring the user to regulate it.

Providing air movement inside the cavity 21 also controls the humidity build-up in the cavity 21. A venting apparatus 80 can also be provided. The venting apparatus 80 is configured to control the temperature and humidity of the cavity 21. A humidity sensor coupled to a PC board or located remotely, used to detect the level of humidity inside the cavity, permitting electronics on a factory preset or the user, to set the amount of humidity that is required to be in the cavity. The electronics coupled with the humidity sensor can provide control for the venting by opening or closing vents and/or turning on or off a fan/blower. An actuator 82 can be coupled to the venting apparatus 80 to selectively open and close the venting apparatus 80. The actuator 82 is selected from a group including a motor, cylinder, biasing member and a bi-metal device. The actuator 80 can also be a screw drive 81, a gear device 83, and a solenoid device 85 coupled to an appropriate controller on the user interface 40. (See FIGS. 29–33) Having a variable speed fan motor inside the cavity 21 or mounted outside the cavity 21 can provide different air flows as needed to prevent moisture build-up or temperature differences by regulating fresh air entry into the cavity 21. The fan can be coupled to the venting apparatus 80. Preventing temperature differences in the cavity 21 of the warmer drawer 12 improves the food holding characteristics of the warmer drawer with a fan 84. The resulting air movement by a fixed or variable speed fan 84 can hold a uniform temperature throughout the inside cavity. The fan 84 can also be used for ducting heated air or moisture out. This can improve on the quality of the food stuff FS being held in the cavity.

A factory preset warmer drawer 12 can serve, for example, as a multi-use warmer drawer/mini oven, warmer drawer/broiling cavity, mini warmer drawer/oven, multi-use warmer drawer/microwave oven, multi-use warmer drawer/baking oven, and multi-use warmer drawer/steam drawer. Combining the warmer drawer with the other heating or cooking products can reduce appliance space used in a kitchen. The warmer drawer 12, with the electronic control device 66, can be configured to function in a mode selected from a mode group including boiling, broiling, oven, microwave oven, and a combination of at least any two of such modes. Using these dual use/multi-use drawers can save energy due to their small size. A large part of cooking is done with small amounts of food. Having to heat up a large oven takes time and costs more than using a mini warmer drawer oven. This oven/warmer drawer could take the place of a toaster oven saving counter space. When combined with a broiling element you could cook and provide holding capabilities not presently found in any other product. It is contemplated that combining the warming appliance with other types of food cooking products can be of a great benefit to a home kitchen or other location. A factory preset warmer drawer 12 or multi-use drawer can be configured as an independent modular unit having the ability to be placed or integrated into a range or other appliance(s) 10 without being built in. A modular warmer drawer 12 or multi-use drawer can be operated independently from the other appliance 10 it is placed into. One could remove the lower conventional drawer of a free standing range below the oven and install the factory preset warmer drawer 12 modular unit thereby providing added cooking space and food holding capability. This warmer drawer 12 or multi-use drawer would operate independently of the freestanding range 10 having replaced the pull-out drawer below.

A factory preset warmer drawer 12 can be configured to be a mobile pedestal heated chamber with drawers, slides, or doors for cooking and holding food and non-food applications. A heated chamber appliance that is not built into a wall, cabinetry 14, a structural member, or into an immovable island can rest on the floor or on other surfaces and be free standing on its own. The appliance (warmer drawer/multi-use drawer) or its containment can rest upon its own structure 18 by: footpads 15, foot pegs, wheels 13, or casters 16. The structure attachment 18 can be coupled directly to the warmer drawer/multi-use drawer 12 or to a mobile frame. The structure attachment 18 can be removed when not in use or it can be permanently attached. The warmer drawer 12 can be removed and placed on a surface for use and returned to the structure attachment 18 carrier. The structure attachment 18 can be made of wood, metal, or plastic. The attachment structure 18 can couple to the warmer drawer with fasteners, such as clips or bolts, or the like. A mobile heated warmer drawer 12/multi-use drawer can be configured to be portable for indoor or outdoor use/applications or both.

Another embodiment of a factory preset and/or detection warmer drawer 12/multi-use drawer can be configured to be controlled by electronic(s) 66 and equipped with an A/C or D/C electronic temperature sensor(s)/scanner detection(s) 70 located inside the cavity or a chamber 21. The temperature of the cavity or item, for example food stuff FS or a plate, pan or dish, placed into the cavity can be detected accurately and only an on/off switch(s) 48 is required for user interface 40. Any electric, electromechanical, or mechanical sensor(s)/scanner detection(s) 70 can be used for detecting a temperature, resistance (current), or power for the control of the cavity temperature. A warmer drawer 12 having factory presets can be controlled by a fixed temperature thermostat, thermal-disk, thermal protector, infrared sensor, thermal cutoff, or electronics, electromechanical, or mechanical temperature controller/sensor detector 70. A warming drawer 12 can be configured to detect items placed inside the cavity, sense the temperature of the item, and then set temperature(s) for maintaining a required temperature based on the sensed reading of item temperature with the electronics correlating temperature to a factory preset electronic logic table, as part of the PC board electronics, as to what the proper temperature set point should be set inside the cavity and controlling/maintaining to this set point. This ability to detect and control temperature can be done by electronic 66 or electro-mechanical, or by mechanical controls. The heating element(s) 34 is electronically, electromechanically or mechanically connected to a temperature-sensing device 70 and is A/C or D/C powered 64 in accordance with requirements for the unit. With factory selected settings, preset settings of the electronic, electromechanical, or mechanical control(s) are needed to maintain the desired temperature(s) within the chamber as sensed by the temperature-sensing/detecting device(s) within a predetermined desired range of operating temperature(s) or set point(s). A user interface 40 may include a plurality of food type designators 42, with each designator assigned a predetermined temperature stored in the electronic control device 66. The electronic control device 66 can be a PC board having electronics mounted on it, for example a microprocessor 68 which receives signals from the various sensors 70 and sends signals to the power circuit 62 of the heating element 34 and related equipment, such as a fan 84.

The sensor 70 can be mounted on an electronic board or it can be attached directly to any wall or location in which detection of the item and cavity temperature can be made. Electronic sensing is far more accurate and faster in sensing temperatures than the mechanical types. It is also apparent that other electronic, electromechanical, or mechanical sensor(s) such as a disc thermostat can be used with electronic control(s) at different locations to provide better response and result in better food holding capabilities.

Another embodiment of a factory preset and/or detection warmer drawer 12/multi-use drawer as configured for outdoor locations. The warmer drawer 12/multi-use drawer having only an on/off switch 48 for control of drawer 12 minimizes problems of exposure. With the use of a remote control unit 75, for example infrared and radio frequency, electronic controls can be used and provide remote operations when used outdoors thus reducing the effects for some of the environment on the controls. Enclosed electronic(s), mechanical switch(s) and control(s) will not be subject to environmental conditions as are exposed mechanical controls and switches. Having factory preset functions and controls located inside or adjacent to the cavity chamber 21 of the warmer 12 drawer will improve appearance and minimize maintenance. This will also provide better extreme temperature and weather resistance and prevent mechanical moving parts from failure as well as electronic(s). The remote control unit 75 can be configured to removably couple to the warming appliance 12, for example using a pin 76 and clip 77 mechanism. (See FIGS. 17–20).

Another embodiment of the warmer drawer 12/multi-use drawer includes a light 50 to illuminate the drawer cavity 21 when the drawer 12 is opened or when a switch 46 is activated. The switch 46 can be mechanical (See FIG. 13) or electronic (See FIG. 14). Because the drawer 12 may be low to the ground and with a small opening it is sometimes hard to see inside the drawer 12. The use of a light 50 to illuminate the inside is of great help when trying to view the food FS without opening the drawer fully. Also, it is contemplated to use a glass door or other transparent materials closing the opening 21 of the enclosure 20 and to provide the ability to see into the warmer drawer 12 without the loss of heat and the ability to control the temperature better for food holding. It is also contemplated that the appliance is equipped with readout indices to show what operations are active in the drawer 12. This would provide the user with feedback as to the operation of the drawer 12.

Another embodiment of a warmer drawer 12/multi-use drawer provides a drawer actuator 33 coupled to the drawer 12 that can move the drawer 12 from one position to another position, for example, to move the drawer in and out of the interior space of the enclosures 20. The drawer actuator 33 can be mechanically or electronically controlled, for example by an electronic motor or a fluid cylinder. The drawer actuator 33 can be controlled by a signal device, for example, a voice activated switch or by an electromagnetic signal, for example, a radio frequency or infrared frequency signal from a hand-held controller. The drawer 12 can also be activated by touching the drawer door, braking a beam, interrupting a signal, or having a feedback signal to a sensor/detect with no hand held control or having contact with the drawer. The drawer 12 can also be configured to be non-moving but access to the drawer 12 is provided by moving the member (wall) 32 configured to close the opening 22 in the enclosure 20 containing the drawer 30. The member (wall) 32 can be coupled to the drawer actuator 33 to move the member (wall) 32 as described for the drawer 12 immediately above.

Another embodiment of a warmer drawer 12/multi-use drawer is configured for use with factory preset: Programmed set point(s), Programmed set time(s), and Programmed set operation(s) as well as preset of time(s) both on and off for users. Timed off control can be provided if the user requires the ability to control the off time of the drawer 12. Off time(s) can be preset by the factory for the end user. The advantage of using factory preset(s) is to have the warmer drawer/multi-use drawer 12 control these functions rather than a user, thereby minimizing user error in not setting to the proper settings or knowing what the proper setting should be. Factory preset can have one, two or more functions, operations, set point(s) with limitless programming for control of these items without user interface. Factory preset can have different functions or operations and having more than one entered into the electronic(s), electromechanical(s), mechanical control without user interface.

Another embodiment of a warming appliance 12 includes a timing device 44 on the electronic(s) display 40. This can be changed to permit other programmable information to be displayed. Another embodiment of a warming appliance 12 includes a depository 86 for fragrant gases/liquid/solid substances in gaseous communication with the drawer 30.

A microprocessor is a computer processor on a microchip. It is sometimes called a logic chip or CPU (central processing unit). A microprocessor is designed to perform arithmetic and logic operations that make use of small number holding areas called registers. Typical microprocessor operations include adding, subtracting, comparing two numbers, and fetching numbers from one area to another. These operations are the result of a set of instructions that are part of the microprocessor design. When a warmer drawer is turned on, the microprocessor is designed to get the first instruction from basic input/output system. The control unit of a microprocessor directs the operation of the other units by providing timing and control signals. It is the function of the microprocessor to execute programs, which are stored in memory in the form of instructions and data. The words fetch and execute are used to describe the actions of the control unit. It fetches an instruction by sending an address and a read command at a memory unit. The instruction at the memory address is transferred to the control unit for decoding. It then generates the necessary signals to execute the instruction. In order to function, a microprocessor requires a power supply, clock and memory. Microprocessors are responsible for interpreting instructions gathered from input devices and transmitting the results to output devices. The prime use of a microprocessor is to read data, perform extensive calculations on that data and store those calculations in a mass storage device or displays the results for human eye with the use of support electronics. The motherboard or main board stands for the card or PC board in the warmer drawer that controls almost all the other peripherals. Thus Microprocessor or CPU (central processing unit) can either mean the physical chip mounted on a motherboard, or it can mean the core within the chip. The microprocessor is a functional component, which provided instructions for executing (add, subtract, shift, fetch, etc.) as part of a complete electronic circuit that consists of other parts.

For purposes of this disclosure, the term "coupled" means the joining of two components (electrical, electromechanical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components or the two components and any additional member being attached to one another. Such joining may be permanent in nature or alternatively may be removable or releasable in nature.

Thus, there is provided several exemplary embodiments of a factory preset warming appliance/warming drawer/multi-use drawer 12 having preset temperature modes.

What is claimed is:

1. A warming appliance having factory pre-set temperature modes, the warming appliance comprising:

an enclosure defining an interior space and having an opening;

a drawer configured to be reciprocally moved within the interior space, the drawer having a member configured to close the opening;

a heating apparatus to change the temperature inside the drawer to a factory pre-determined temperature;

a user interface associated with the drawer; and a temperature control apparatus coupled to the heating apparatus and connected to an IR sensor and a humidity sensor to ensure that food stuff contained in the drawer is maintained at a factory pre-determined temperature.

2. The warming appliance of claim 1, wherein the heating apparatus is mounted in the interior space proximate the drawer.

3. The warming appliance of claim 1, wherein the heating apparatus is mounted external to the drawer and is in communication with the interior space.

4. The warming appliance of claim 2, where the opening is front facing.

5. The warming appliance of claim 4, wherein the temperature control apparatus includes:

a detector configured to sense the temperature in the drawer;

a power circuit electrically connected to the detector, heating apparatus, user interface and an energy source; and an electronic control device coupled to the detector and power circuit to control the temperature in the drawer within a predetermined range.

6. The warming appliance of claim 5, wherein the detector is mounted in the enclosure.

7. The warming appliance of claim 6, wherein the electronic control device is configured to function in a mode selected from a mode group including boiling, broiling, oven, baking, steam, microwave oven, and a combination of at least any two of such modes.

8. The warming appliance of claim 1, wherein the user interface provides an on/off function and the ability to select a factory preset temperature further controlled by at least one of a fixed temperature thermostat, thermal-disk, thermal protector, thermal cutoff, or electronics, electromechanical, or mechanical temperature controller/sensor detector.

9. The warming appliance of claim 7, wherein the electronic control device includes a microprocessor configured to process a) the detection of an item placed inside the cavity, b) the sensing of the temperature of the item, and c) then setting of a preferred temperature in light of the sensed reading of item temperature by correlating a preferred temperature to a factory preset electronic logic table.

10. The warming appliance of claim 9, wherein the user interface includes a plurality of food type designators, with each designator assigned a predetermined temperature stored in the logic table in an electronic control device that maintains the temperature within the chamber within a predetermined optimal range of operating temperatures or set points.

11. The warming appliance of claim 9, including a sensor mounted in the drawer to sense the temperature of food stuff contained in the drawer and provide a signal to the electronic control device proportionate to the temperature of the food stuff, wherein the electronic control device will maintain the temperature of the drawer at one of the sensed temperature of the food stuff and factory preset temperature.

12. The warming appliance of claim 5, wherein the enclosure is one of free-standing and cabinet mounted.

13. The warming appliance of claim 12, wherein the free-standing enclosure is configured to be moved.

14. The warming appliance of claim 9, including a venting apparatus that is electronically controlled to adjust the temperature and humidity of space defined by the drawer.

15. The warming appliance of claim 14, wherein the venting apparatus is coupled to the IR sensor and the humidity sensor in the cavity.

16. The warming appliance of claim 14, wherein the venting apparatus includes an actuator configured to selectively open and close the venting apparatus cavity to hold the humidity at a certain level or reduce it.

17. The warming appliance of claim 14, including a blower associated with the enclosure and in fluid communication with the venting apparatus to move air in the drawer.

18. The warming appliance of claim 17, including a depository for fragrant substances in gaseous communication with the drawer.

19. The warming appliance of claim 18, wherein the user interface includes a timing device.

20. The warming appliance of claim 19, wherein the user interface includes a light switch coupled to a light fixture mounted in the enclosure.

21. The warming appliance of claim 19, wherein the enclosure is configured for use outdoors.

22. The warming appliance of claim 14 is configured as an independent modular unit for integration with another appliance.

23. The warming appliance of claim 14, including an information output device that is viewed remotely from the appliance.

24. The warming appliance of claim 23, wherein the information output device includes a digital display.

25. The warming appliance of claim 23, wherein the user interface is remote from the warming appliance and is combined with the output device.

26. The warming appliance of claim 14, wherein the heating apparatus is coupled to a fan for air movement in the enclosure.

27. A warming appliance of claim 14, wherein the drawer includes transparent material providing visual access to the enclosure.

28. A warming drawer associated with a cooking appliance, wherein the cooking appliance is one of a free-standing unit and a built-in unit, the warming drawer comprising:

an enclosure defining an interior space and having an opening;

a drawer having a member configured to close the opening;

a heating apparatus configured to change a temperature inside the drawer to a predetermined temperature defined by values in a logic table for certain types of foods;

a user interface associated with the drawer; and a temperature control apparatus coupled to the heating element and user interface, and associated with the enclosure, wherein food stuff contained in the drawer is maintained at a factory pre-determined temperature and automatically adjusted based on input received from sensors in the interior space to thereby minimizing user error in not setting to the proper settings or knowing what the proper setting should be.

29. The warming drawer of claim 28, wherein the heating apparatus is mounted in the interior space proximate the drawer.

30. The warming drawer of claim 28, wherein the heating apparatus is mounted external to the drawer and is in communication with the interior space.

31. The warming drawer of claim 28, where the opening is front facing.

32. The warming drawer of claim 31, wherein the temperature control apparatus includes:

a detector configured to sense the temperature in the drawer;

a power circuit electrically connected to the detector, heating apparatus, user interface and an energy source; and an electronic control device coupled to the detector and power circuit to control the temperature in the drawer within a predetermined range.

33. The warming drawer of claim 32, wherein the electronic control device is configured to function in a mode selected from a mode group including boiling, broiling, over, baking, steam, microwave over, and a combination of at least any two of such modes.

34. The warming drawer of claim 32, wherein the detector is a PTC thermistor mounted in the enclosure.

35. The warming drawer of claim 28, wherein the user interface only provides an on/off function.

36. The warming drawer of claim 34, wherein the electronic control device includes a microprocessor.

37. The warming drawer of claim 36, wherein the user interface includes a plurality of food type designators, with each designator assigned a predetermined temperature stored in the electronic control device.

38. The warming drawer of claim 32, including a sensor mounted in the drawer to sense the temperature of food stuff contained in the drawer and provide a signal to the electronic control device proportionate to the temperature of the food stuff, wherein the electronic control device will maintain the temperature of the drawer at one of the sensed temperature of the food stuff and a factory preset temperature.

39. The warming drawer of claim 28, wherein the enclosure is mounted in a position, wherein the position is one of above the associated cooking appliance, left of the associated cooking appliance, right of the associated cooking appliance and under the associated cooking appliance.

40. The warming drawer of claim 38, including a venting apparatus configured to control the temperature and humidity of space defined by the drawer.

41. The warming drawer of claim 40, wherein the venting apparatus is coupled to a humidity sensor in the cavity to hold the humidity at a certain level or reduce it.

42. The warming drawer of claim 40, wherein the venting apparatus includes an actuator configured to selectively open and close the venting apparatus.

43. The warming drawer of claim 40, including a blower associated with the enclosure and in fluid communication with the venting apparatus to move air in the drawer.

44. The warming drawer of claim 43, including a depository for fragrant substances in gaseous communication with the drawer.

45. The warming drawer of claim 28, wherein the user interface includes a timing device.

46. The warming device of claim 44, wherein the user interface includes a light switch coupled to a light fixture mounted in the enclosure.

47. The warming drawer of claim 28, wherein the enclosure is configured for use outdoors.

48. The warming drawer of claim 38, wherein the enclosure is one of free-standing and cabinet mounted.

49. The warming drawer of claim 48, wherein the free-standing enclosure is configured to be moved.

50. The warming drawer of claim 28 is configured as an independent modular unit for integration with the cooking appliance.

51. The warming drawer of claim 28, including an information output device.

52. The warming drawer of claim 51, wherein the information output device includes a digital display.

53. The warming drawer of claim 38, wherein the user interface is remote from the warming drawer.

54. The warming drawer of claim 38, wherein the heating apparatus is coupled to a fan for air movement in the enclosure.

55. A warming drawer of claim 48, wherein the drawer includes transparent material providing visual access to the enclosure.

56. A warmer drawer including:

an enclosure;

a microprocessor within the enclosure;

at least one sensor coupled to the microprocessor for detecting moisture and temperature in the enclosure;

a user interface for selecting a food type and coupled to a logic table in communication with the microprocessor;

a venting apparatus coupled to the microprocessor for venting heat and moisture when necessary;

a fan for circulating air with the enclosure; and a drawer configured to slide out of an opening in the enclosure.

* * * * *

UNITED STATES PATENT AND TRADEMARK OFFICE

CERTIFICATE OF CORRECTION

PATENT NO. : 7,235,762 B2
APPLICATION NO. : 11/147511
DATED : June 26, 2007
INVENTOR(S) : Gagas et al.

It is certified that error appears in the above-identified patent and that said Letters Patent is hereby corrected as shown below:

Column 14

Line 62, change "over" to --oven--. Both occurrences

Signed and Sealed this

Fifth Day of February, 2008

JON W. DUDAS
*Director of the United States Patent and Trademark Office*